United States Patent [19]

Croteau et al.

[11] 4,357,766

[45] Nov. 9, 1982

[54] SNOW PLOW SIDE WING ASSEMBLY

[75] Inventors: Lucien Croteau, St-Valérien de Milton; Alain Marchand, St-Valérien; Bertrand Houle, Drummondville Sud, all of Canada

[73] Assignee: Tenco Machinery Ltd., Ste-Valerien, Canada

[21] Appl. No.: 238,367

[22] Filed: Feb. 26, 1981

[51] Int. Cl.[3] ..... E01H 5/06

[52] U.S. Cl. ..... 37/281; 37/105

[58] Field of Search ..... 37/41, 42 R, 42 VL, 37/50, 105; 172/782

[56] References Cited

U.S. PATENT DOCUMENTS

| | | | |
|---|---|---|---|
| 2,101,666 | 12/1937 | Austin | 37/105 |
| 2,193,532 | 3/1940 | Frink | 37/42 R |
| 2,491,797 | 12/1949 | Burns | 37/105 |
| 2,632,262 | 3/1953 | Whittey | 37/42 R |
| 2,643,470 | 6/1953 | Kaeser | 37/42 VL X |
| 2,991,566 | 7/1961 | Sumner et al. | 37/42 R |
| 3,125,818 | 3/1964 | Kraft et al. | 37/42 R |
| 3,659,363 | 6/1970 | Snyder | 37/42 R |
| 4,045,892 | 9/1977 | Farrell | 37/105 |
| 4,096,652 | 6/1978 | Raines | 37/41 |

FOREIGN PATENT DOCUMENTS

| | | | |
|---|---|---|---|
| 23012 | 2/1949 | Finland | 37/42 R |
| 59818 | 9/1938 | Norway | 37/42 R |
| 165800 | 1/1959 | Sweden | 37/41 |

*Primary Examiner*—E. H. Eickholt

*Attorney, Agent, or Firm*—Swabey, Mitchell, Houle, Marcoux & Sher

[57] ABSTRACT

A snow plow side wing assembly is provided which is hydraulically operated and simply constructed such that it can be easily scaled down for mounting on a lightweight pickup truck. The assembly includes a wing blade, a lightweight frame adapted to be mounted to a vehicle, a pair of upstanding posts mounted fore and aft of the frame with each post including track means and a travel carriage mounted for sliding movement in the track means, and a hydraulic piston and cylinder arrangement mounted on the opposite side of the post to the track means with the cylinder mounted to the base of the post and the cylinder extending upwardly from the cylinder parallel to the post and connected to an extension arm extending parallel to the post and connected to the carriage. Two supporting arms extend from the carriage, both supporting arms being pivotally articulated to the carriage and to separate points on the end of the blade. One of these support arms is connected to a lost motion slide on the blade so that the blade is free to move in a vertical plane in response to the varying contour of the road bed. In a larger scale embodiment of the invention, the carriage includes an offset pivot bracket to the pivot brackets of the support members and the piston and cylinder arrangement is pivotally connected to one of the support members such that when the wing blade is moved upwardly and inwardly towards the vehicle, the tendency of the arms to bind will be reduced.

7 Claims, 11 Drawing Figures

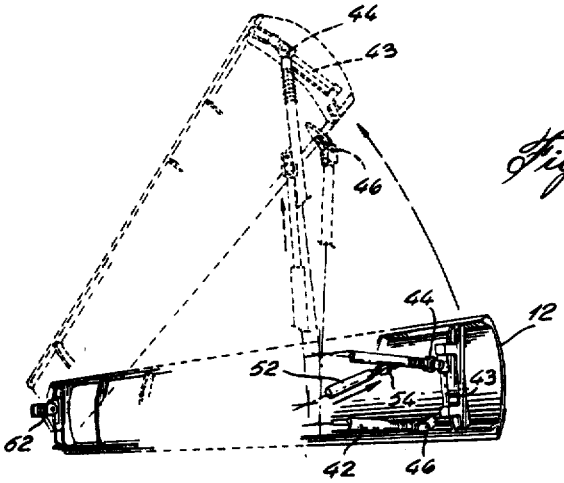
Fig. 5
Fig. 8
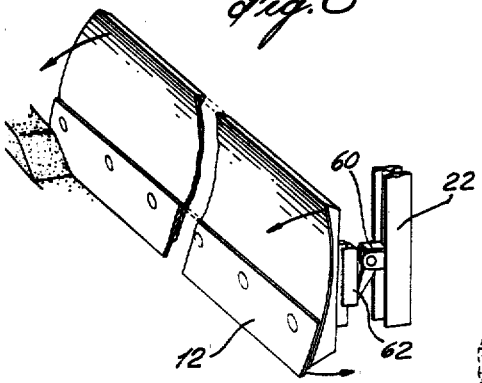
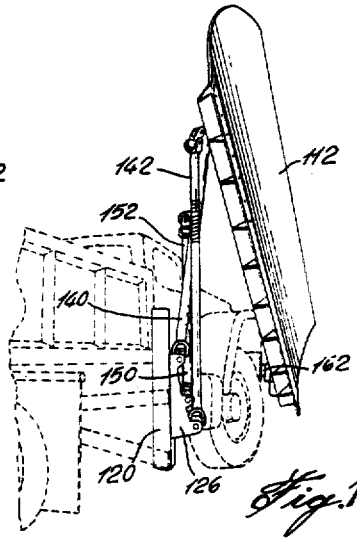
Fig. 11

SNOW PLOW SIDE WING ASSEMBLY

BACKGROUND OF THE INVENTION

1. Field of the Invention

The present invention relates to snow plows, and more particularly to a snow plow wing attachment.

2. Description of the Prior Art

Present day wing blades on snow plows are usually mounted at their front end to a slider device on a frame mounted to the side of a cab of a vehicle, while the rear of the wing blade is held by pivotally connected support arms with means for lifting the end of the blade and drawing it more closely to the cab of the vehicle when the wing blade is not in use. The means for lifting and drawing in the end of the wing blade to the cab vehicle is conventionally based on a system of pulleys and cables, as illustrated in U.S. Pat. Nos. 2,632,262, Whittey, 1953; 2,193,532, Frink, 1940; and 3,125,818, Kraft et al, 1964; and Canadian Pat. No. 609,002, Obst, 1960.

More recently, attempts have been made to eliminate the use of cables and overhanging frames so as to simplify the construction of the apparatus required for a wing blade on a snow plow. Such examples are shown in U.S. Pat. Nos. 4,045,892, Farrell, 1977; and 4,096,652, Raines et al, 1978. In the Farrell patent, mere front and rear posts are provided on which sliders are mounted and hydraulically controlled, while an additional hydraulic cylinder arm is provided between the support arms for moving the side wing upwardly and closer to the cab in the case of non-use of the wing blade. In the case of the Raines et al patent, there are no posts to support the rear of the snow plow, but the support members are merely pivoted to a support member mounted to the frame of the vehicle while the front of the blade is adapted to travel vertically on the basis of the cable and pulley system. It has been found, however, that with the evolution of hydraulic components in the control and support of the wing blade, more arms are required to control the end of the wing tip as shown in the Raines et al and Farrell patents, and the proliferation of these arms in some constructions has the disadvantage of the arms being constrained one against the other from moving the plow into an intimate proximity to the cab of the vehicle. Further, it has been found in the utilization of hydraulic cylinders and rigid support members that the wing tip is less subject to vertical play when in use, that is, when the lower scraping edge of the plow or wing blade meets a small bump or other obstacle, the wing blade has less of a possibility of moving upwardly and over such a bump which might be found in the road bed since it is being held in a triangle of arms which hold the plow in an almost fixed condition. Furthermore, it is still found that as in the Farrell patent, the posts must be made considerably higher than would be desirable since it must be high enough to contain the full piston and cylinder arrangement controlling the slide of the support member arms especially when the hydraulic cylinder and piston is being telescoped to move the slide upwardly. The posts must be high enough to give the slide sufficient travel.

SUMMARY OF THE INVENTION

It is an aim of the present invention to provide an improved lightweight snow plow wing attachment for attachment on road truck bodies of a size commonly used for snow clearing in the winter months and for haulage in the summer months.

It is a further aim of the present invention to provide a wing blade for a snow plow similar to that illustrated in U.S. Pat. No. 4,045,892, Farrell, but which is an improvement thereover in terms of its more simple construction and which allows the side wing blade to be brought in closer to the cab of the vehicle when not in use.

It is a further aim of the present invention to provide a wing blade which will have sufficient vertical play to move over slight bumps in roadways.

It is also an aim of the present invention to provide a side wing snow plow attachment which can be adapted for use on lightweight truck bodies, such as so-called "three-quarter" ton bodies or pickup trucks. It is common for private snow-clearing contractors to use three-quarter ton trucks sometimes with four-wheel drive, with a snow plow attachment on the front thereof, for clearing snow in driveways, parking lots and school yards. Such trucks or vehicles are seldom provided with side wing plows. The weight of scaled-down conventional side wing attachments and the necessary frame for mounting these attachments is considerably more than can be handled by a typical lightweight pickup truck.

In a construction in accordance with the present invention, a side wing snow plow assembly is provided with front and rear upstanding guide posts adapted to be mounted to the frame of a vehicle on the side thereof. At least the rear guide post includes track means and a traveling carriage mounted on said track means for vertical sliding movement on the guide post. A hydraulic piston and cylinder means is mounted on the opposite side of the guide post to the track with the cylinder mounted to the base of the guide post and the piston extending upwardly from the cylinder parallel to the guide post and connected to an extension arm extending parallel thereto but on the track side of the guide post and connected to the carriage, the piston and cylinder being extendable to move the extension arm and carriage upwardly in the track means, and means connecting the front of the snow plow wing to the carriage on the forwardmost post and means connecting the rear portion of the side wing plow to the carriage on the rearmost post.

In another aspect of the present invention, there is provided a snow plow wing blade assembly comprising a frame adapted to be mounted to a vehicle carrying the side wing blade, means for mounting the front end of the wing blade to the frame in a pivotal manner, means for mounting the rear portion of the wing blade at an angle to the axis of the vehicle such that said means includes an upstanding post on the frame, a carriage slidably mounted on the post for sliding vertical movement thereon, positive means for sliding the carriage, a pair of support arms universally mounted at one end to spaced-apart connecting points on the carriage in a common vertical plane, the other end of the support arms being universally connected at spaced points on the side wing blade, a hydraulic piston and cylinder arrangement connected to the carriage in a universal manner at a point of connection between and spaced apart from the previous mentioned points of connection and offset from the common plane of the previous points of connection at one end thereof, and being universally connected to an intermediate portion of one of the support members at the other end thereof, such that when the hydraulic piston and cylinder are actuated, the rear portion of the wing blade will be moved upwardly and inwardly towards an inoperative position whereby the snow plow blade is parallel to the vehicle and close thereto.

In a still further aspect of the present invention, there is provided a snow plow assembly comprising a frame adapted to be mounted to a vehicle carrying the side wing blade, means for mounting the front end of the wing blade to the frame such that it pivots in a vertical plane, means for mounting the rear portion of the wing blade at an angle to the axis of the vehicle such that said means includes an upstanding post on the frame, a carriage slidably mounted on the post, a pair of support arms universally mounted at one end to spaced-apart connecting points on the carriage in a common vertical plane, the other end of the support arms being connected at spaced points on the wing blade with one of the ends of the support arms being slidably connected to a bracket means on the blade such that the blade can move in a vertical plane relative to the end of the support arm, a hydraulic piston and cylinder arrangement connected to the carriage in a universal manner at a point of connection between and spaced apart from the previous mentioned points of connection and being universally connected to an intermediate portion of the support member slidably connected to the wing blade.

BRIEF DESCRIPTION OF THE DRAWINGS

Having thus generally described the nature of the invention, reference will now be made to the accompanying drawings, showing by way of illustration, a preferred embodiment thereof, and in which:

FIG. 5 is a partly schematic view of the rear of the wing tip blade showing details thereof and showing the blade in an upright position in dotted lines;

FIG. 8 is a fragmentary perspective view of the blade showing an operational detail thereof;

FIG. 11 is a perspective view showing the wing blade according to the embodiments of FIGS. 9 and 10 with the blade in an upright stored position.

DESCRIPTION OF THE PREFERRED EMBODIMENTS

Figure 1:
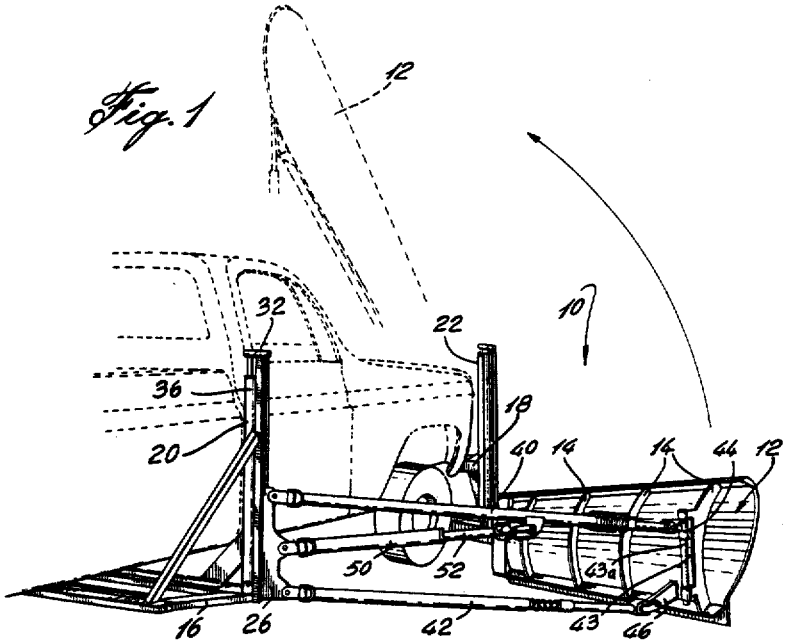
FIG. 1 is a perspective view of a snow plow arrangement in accordance with the present invention, showing a vehicle in dotted lines.

Referring now to the drawings, a snow plow side wing attachment is identified as 10 and includes a blade 12 having reinforcing ribs 14. The vehicle shown in dotted lines is adapted to receive frame members 16 and 18 which mount respectively guide posts 20 and 22.

On the front guide post 22, a carriage is provided to which is pivotally mounted the front end of the blade 12. On the rear post 20, a channel-shaped track 24 is provided in which a carriage 26 can slide.

Figure 2:
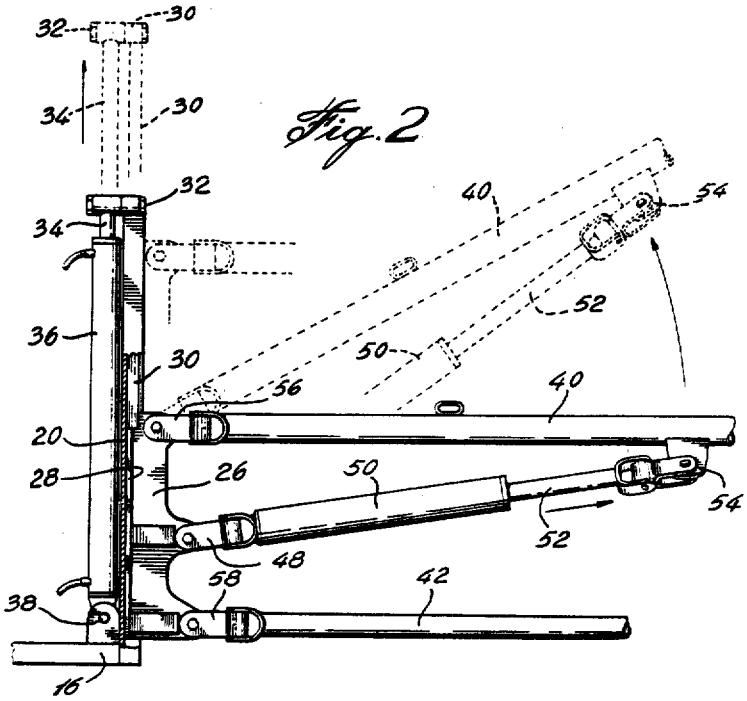
FIG. 2 is an enlarged fragmentary view of a detail shown in FIG. 1.
Figure 4:
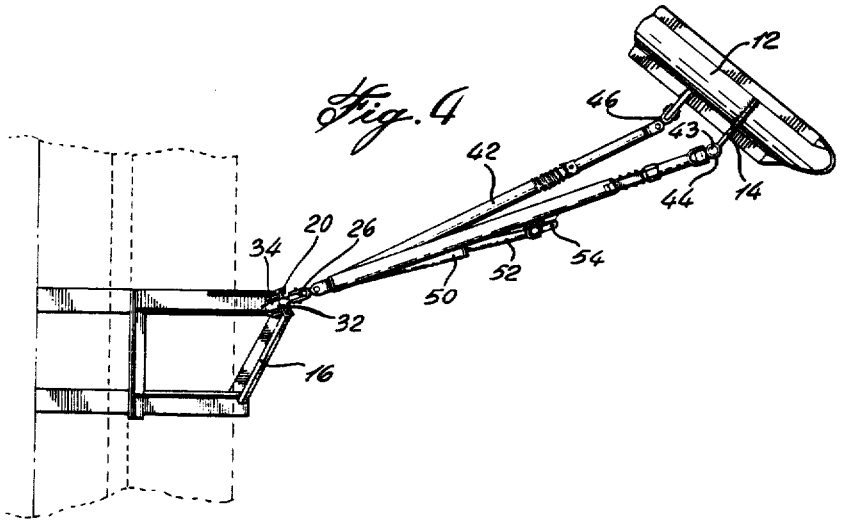
FIG. 4 is a top plan fragmentary view of the side wing blade shown in FIG. 1.
Figure 3:
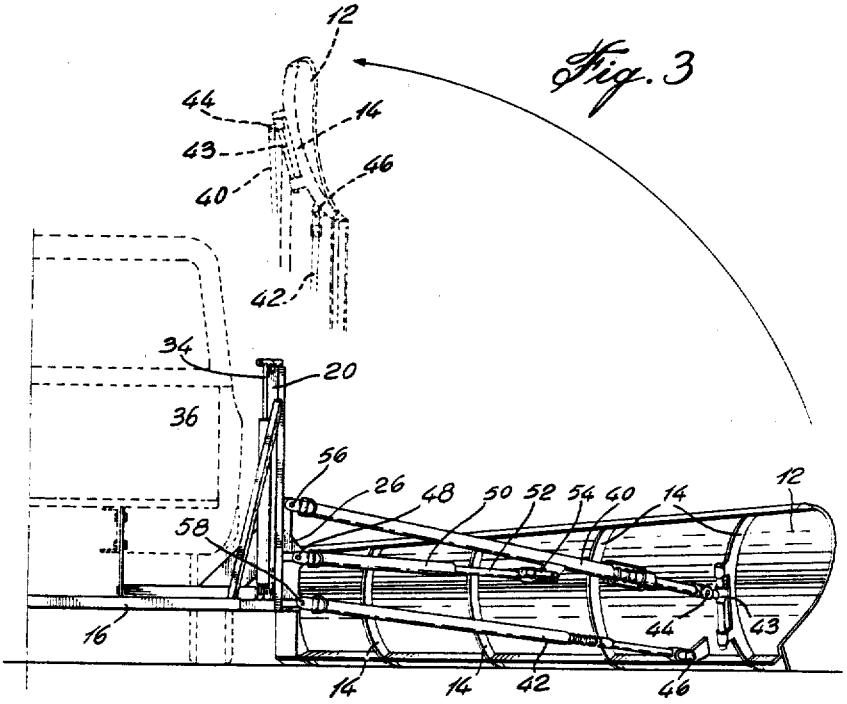
FIG. 3 is a rear elevational view of one embodiment of a snow plow side wing blade.

The carriage 26 includes flanges 28 adapted to be engaged within the channel-shaped track for vertical sliding of the carriage 26. Carriage 26 also mounts an extension arm 30 which is connected at the top thereof to a T member 32 which in turn is mounted to a piston 34 which projects from hydraulic cylinder 36. Hydraulic cylinder 36 is mounted at the bottom of the guide post to the base of the frame at 38. Accordingly, by actuating the piston 34 and cylinder 36 hydraulically, the carriage 26 can be lifted as the piston 34 extends as shown in dotted lines in FIG. 2.

From the carriage 26 a pair of support members 40 and 42 extend outwardly and are connected universally to the end of the plow blade 12 at 44 and 46. A slide 43 is provided at the connection 46 for the upper support 42. The slide 43 is in the form of a bracket mounted to the outermost rib 14 and includes a rod 43*a* on which a sleeve 47 is journaled. The sleeve 47 is welded to a sleeve 49 which has an axis at 90° to the sleeve 47. The sleeve 49 is journaled on a spindle subtended at the end of support arm 40. The rod 43*a* is affixed to the rib 14 by means of rigid brackets 43*b*. A hydraulic cylinder 50 and piston 52 arrangement is pivoted on the carriage 26 at 48 where it is universally connected to the carriage 26 and at its other end at a point 54 on the support member 40. Support members 40 and 42 are both universally connected to the carriage at respective points 56 and 58.

Figure 7:
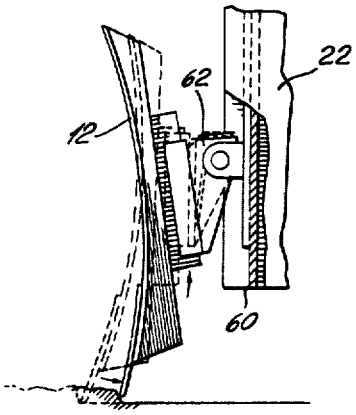
FIG. 7 is a fragmentary elevational view, partly in cross-section, of a further detail of the wing blade.
Figure 6:
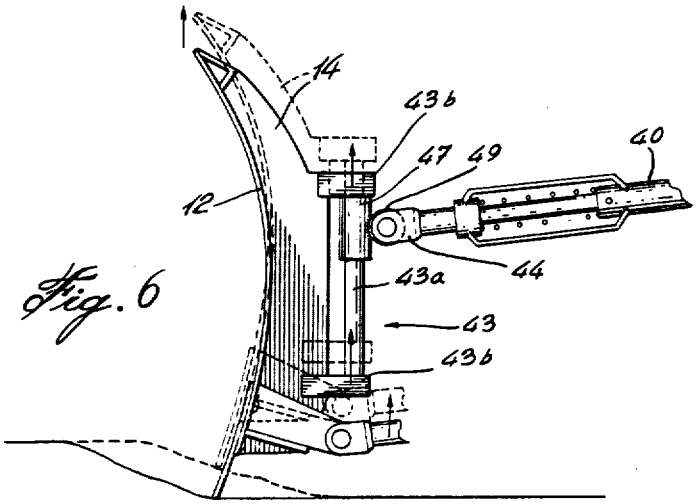
FIG. 6 is a fragmentary elevational view, partly in cross-section, of a further detail of the wing tip blade.

The front end of the wing blade 12 is mounted to carriage 60 by means of a spring pivot bracket 62. The carriage 60 is, of course, mounted for sliding movement on the post 22 in a manner similar to the carriage 26 on post 20. The spring bracket 62, as shown in FIG. 7, allows some flexibility of torsional play about the longitudinal axis of the wing blade 12 when the scraping edge of the wing blade 12 engages slight obstacles on the road surface. As shown in FIG. 6, the slide 43 provides free vertical movement of the end of the wing blade 12 relative to the connection or coupling 44. The connection 44 remains in a relatively fixed position due to the piston and cylinder arrangement 50 and 52. However, the support arm 42, which is universally connected at both ends thereof to the carriage 26 and the bracket 46 respectively, will allow movement in a vertical plane of the wing blade. The sleeve 47 of the coupling 44 will thus ride on the rod 43*a* as the scraper edge of the wing blade 12 moves over the contour of the actual road bed, as shown in dotted lines in FIG. 6.

Figure 9:
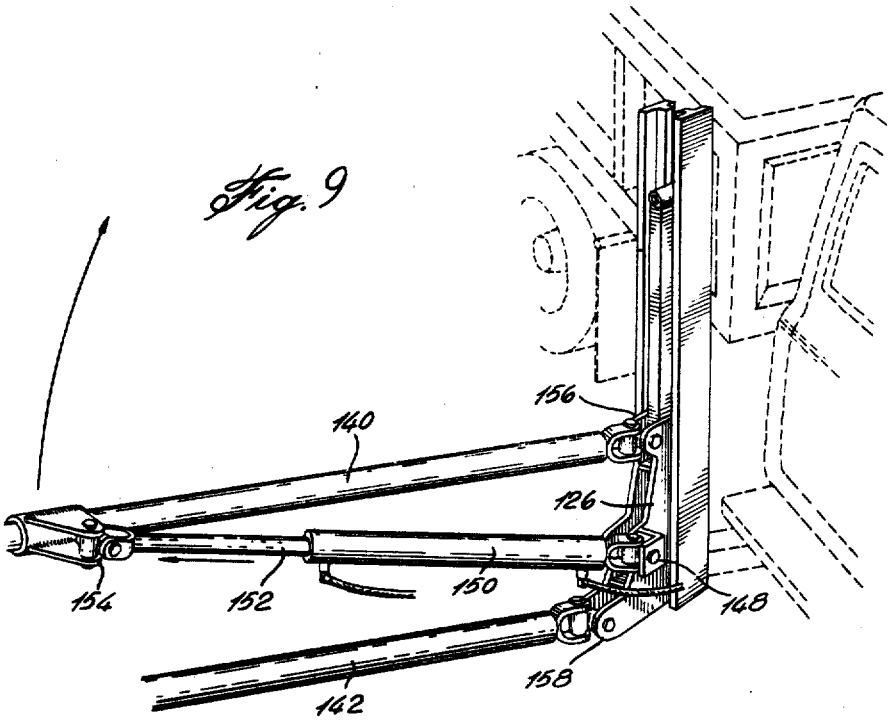
FIG. 9 is a fragmentary perspective view of a further embodiment of the support structure for the wing blade.
Figure 10:
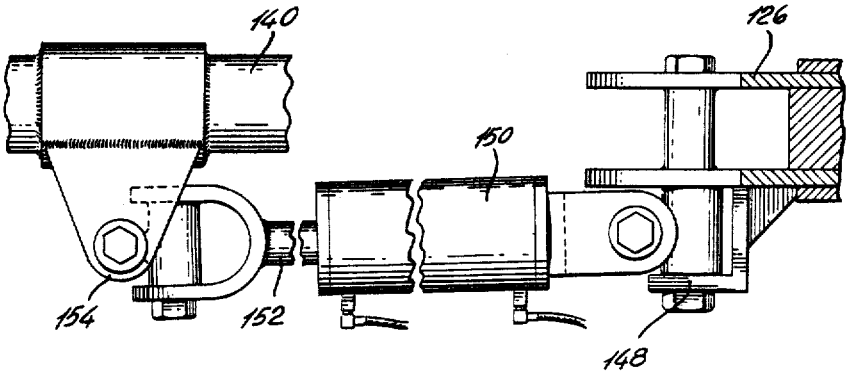
FIG. 10 is an enlarged fragmentary plan view, partly in cross-section, of a detail of the embodiment shown in FIG. 9.

In the embodiments shown in FIGS. 9 through 11, there is illustrated a larger version of the wing blade attachment particularly suited for conventional snow plow vehicles for cleaning off highways and city streets. In this case, one problem which occurs is in using a hydraulic support and lifting system wherein three arms are necessary, that is, two articulated support arms and an actuating arm in the form of a piston and cylinder arrangement. In conventional setups, the three pivot points of the arms on the carriage mounted to the frame on the vehicle must be relatively close together such that when the wing blade is lifted and brought in close to the vehicle, the arms bind, thus preventing close intimate nesting of the wing blade. Accordingly, the arrangement in FIGS. 9 through 11 shows an offset pivot connection of the piston and cylinder arm so as to reduce or eliminate the binding problem of the arms.

Referring now to FIGS. 9 through 11, there is shown a post 120 on which a carriage 126 is adapted to slide in a manner similar to the carriage 26 described in relation to FIGS. 1 to 5. The carriage 126 includes pivot brackets 156 to which the support arm 140 is universally pivotally connected. In the same plane as pivot bracket 156 is a pivot bracket 158 to which the support arm 142 is articulated. A pivot bracket 148, however, is offset of this vertical plane, as shown in FIGS. 9 and 10. The pivot bracket 148 mounts the cylinder 150 from which extends piston 152 connected at the other end to the support arm 140 by means of the bracket 154. Accordingly, this construction allows the wing blade to be brought in closer together to the vehicle.

We claim:

1. A snow plow side wing assembly comprising front and rear upstanding posts adapted to be mounted on the frame of a vehicle on the side thereof and carrying a snow plow side wing, at least the rear post including track means and a traveling carriage mounted on the track means for vertical sliding movement thereon, a hydraulic piston and cylinder means mounted on the opposite side of the post to the track means with the cylinder of the cylinder means mounted to the base of the post and the piston of the cylinder means extending upwardly from the cylinder of the cylinder means parallel to the post and connected to an extension arm extending parallel thereto but on the track side of the post and connected to the carriage, the piston and cylinder means being extendable to move the extension arm and carriage upwardly in the track means, a forwardmost carriage mounted on said front upstanding post, and means connecting the front of the snow plow wing to said carriage on the forwardmost post, and means connecting the rear part of the snow plow side wing to the carriage of the rearmost post.

2. A snow plow side wing assembly as defined in claim 1, wherein the track means on the post includes a channel-shaped member with a central longitudinal slot and said traveling carriage includes flanges extending at 90° and retained within the track means with the carriage extending from the slot.

3. A snow plow side wing assembly as defined in claim 1, wherein the forwardmost post includes track means and a piston and cylinder arrangement with said forwardmost carriage being a traveling carriage identical to that on the rearmost post, and the front of the side wing has a resilient mounting means mounted to said forwardmost carriage and adapted for torsional play relative to the longitudinal axis of the side wing relative to said forwardmost carriage.

4. A snow plow side wing assembly as defined in claim 3, wherein the mounting means includes a spring-like bracket mounted on the carriage.

5. A snow plow wing blade assembly comprising a frame adapted to be mounted to a vehicle carrying a side wing blade, means for mounting the front end of the wing blade to the frame such that it pivots in a vertical plane, means for mounting the rear portion of the wing blade at an angle to the longitudinal axis of the vehicle such that said means including an upstanding post on the frame, a carriage slidably mounted on the post, a pair of support arms each universally mounted at one end to spaced-apart connecting points on the carriage in a common vertical plane, the other ends of the support arms being connected at spaced points on the wing blade with one of the ends of the support arms being slidably connected to a bracket means on the blade such that the blade can move in a vertical plane relative to the end of the slidably connected support arm, a hydraulic piston and cylinder arrangement connected to the carriage in a universal manner at the point of connection between and spaced apart from the previous mentioned points of connection and being universally connected to an intermediate portion of the support arm slidably connected to the wing blade.

6. A snow plow assembly as defined in claim 5, wherein the bracket means on the blade includes a generally vertically extending rod subtended between said bracket means, the end of the slidably connected support arm including a sleeve journaled on said rod such that although said slidably connected support arm remains fixed because of a triangle formed between the cylinder and piston arrangement and the slidably connected support arm, and the other support arm is freely articulated, the snow plow wing blade will have limited vertical play as a result of the sliding connection between the end of the said support arm and the sliding rod on the wing blade.

7. A snow plow side wing assembly comprising a frame adapted to be mounted to a vehicle carrying a side wing blade, means for mounting the front end of the wing blade to the frame in a pivotal manner, means for mounting the rear portion of the wing blade at an angle to the longitudinal axis of the vehicle such that said means includes an upstanding post on the frame, a carriage slidably mounted on the post for sliding vertical movement thereon, positive means for sliding the carriage, a pair of support arms each universally mounted at one end to spaced-apart connecting points on the carriage in a common vertical plane, the other ends of the support arms each being universally connected at spaced points on the side wing blade, a hydraulic piston and cylinder arrangement connected to the carriage in a universal manner at a point of connection between and spaced apart from the previous mentioned points of connection and offset from the common vertical plane of the other points of connection, at one end thereof, and being universally connected at the other end thereof to an intermediate portion of one of the support arms such that when the hydraulic piston and cylinder arrangement is actuated, the rear portion of the wing blade will be moved upwardly and inwardly towards an inoperative position whereby the snow plow blade is parallel to the vehicle and close thereto.

* * * * *